United States Patent [19]

Saccoccio

[11] 3,987,644

[45] Oct. 26, 1976

[54] CLIP FOR EARRINGS AND THE LIKE

[75] Inventor: Nazareno J. Saccoccio, Cranston, R.I.

[73] Assignee: Aro-Sac Inc., Providence, R.I.

[22] Filed: Oct. 28, 1975

[21] Appl. No.: 626,580

[52] U.S. Cl. ..... 63/14 D

[51] Int. Cl.[2] ..... A44C 7/00

[58] Field of Search ..... 64/14 R, 14 B, 14 C, 64/14 D, 14 E; 24/252 B, 252 J, 248 JE

[56] References Cited

UNITED STATES PATENTS

| | | | |
|---|---|---|---|
| 2,882,702 | 4/1959 | Goldberg et al. | 63/14 B |
| 2,964,927 | 12/1960 | Patterson | 63/14 B |
| 3,176,475 | 4/1965 | Saccoccio | 63/14 D |

*Primary Examiner*—F. Barry Shay

*Attorney, Agent, or Firm*—Salter & Michaelson

[57] ABSTRACT

A clip for earrings comprising separate jaw members pivotally attached. One jaw is adapted to display a decoration and is provided with contact means adapted to contact one side of an ear lobe. The other jaw is movable towards and away from the first jaw and is provided with a generally C-shaped terminal loop portion for transverse receipt of a screw member having a contact adapted to contact the other portion of an ear lobe so that the spacing between the contacts may be altered to change the pressure applied to mount the earring. The C-shape of the loop for receiving the screw member enables the use of a shorter movable jaw which in turn enables the presentation of an overall lower profile of the resultant earring. Additionally, two-point contact between the screw member and the loop is provided so as to increase the ease in which such members may be repositioned.

6 Claims, 6 Drawing Figures

CLIP FOR EARRINGS AND THE LIKE

BACKGROUND OF THE INVENTION

Known earring clips of the spring-pressure type having adjustable contact spacing utilize a transversely mounted screw member which may be moved axially back and forth in relationship to the clip portion to which it is fixed. Accordingly, the spacing between the contact means and thus the amount of pressure that will be applied to the ear lobe of the wearer when in a spring closed position can be varied. A commercial embodiment of such a device is disclosed in U.S. Pat. No. 3,176,475 issued Apr. 6, 1965, to the present inventor. Therein, the terminal portion of a pivotal jaw member is provided with several bent portions so as to provide a plurality of openings and a terminal edge, all of which receive and position the threaded member. The threaded screw member is axially movable back and forth in relationship to the movable jaw so that the contact portion provided at one end thereof is adjustable with respect to the contact provided on the stationary jaw so that the spacing between the opposed contacts is variable.

While commercially acceptable for most purposes, this construction presents a rather high profile inasmuch as those terminal portions of the adjustable jaw which are positioned beneath the screw member and which are reversely bent necessarily require a height addition at least equal to the extent of such reverse curve. In some applications it is desirable to present an earring having an overall low profile, i.e., one in which the curved portion of the fixed jaw more closely hugs the bottom of the ear and renders the attachment means accordingly less noticeable. Thus, it would be desirable for such purposes to present an adjustable earring clip having a lower overall profile.

Furthermore, the plurality of the contact points between the screw member and the terminal loop of the prior construction described could result in binding, due to the presence of three separate contact points between the looped terminal configuration and the threaded member received thereby. Accordingly, it is desirable to produce an earring clip of similar construction having a softer touch, that is, one that presents a construction wherein the screw member is more easily axially movable with respect to the movable jaw portion thereof.

SUMMARY OF THE INVENTION

The present invention accomplishes these aims by the provision of a clip for earrings and the like comprising a fixed jaw member having means for contacting the lobe of the wearer's ear, a movable jaw member pivotally connected to the fixed jaw at one end thereof, and spring means for urging said movable jaw member towards said fixed jaw member. The movable jaw member is provided with a generally C-shaped terminal loop having base, root, and top portions thereof wherein a screw member having a contact member at one end thereof is received through a smooth bore formed within the root portion of the C-shaped loop and having further contact with a terminal top portion thereof so that the overall height of the movable jaw member is reduced and the threading contact between the screw member and the loop portion of the movable jaw occurs at two spaced points.

It is therefore a primary object of the instant invention to provide a clip for earrings and the like having a lower overall profile than that available in prior art devices.

Still another object of the present invention is the provision of a clip for earrings and the like wherein an adjustable screw member for varying the spacing between ear lobe contact members and accordingly the pressure of the earring on the ear is received by and held in position at only two points of the movable jaw, so as to increase the ease by which such screw member may be axially moved relative to such movable jaw.

Other objects, features and advantages of the invention will become apparent when the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

The terms "fixed" or "stationary" as well as the terms "movable", "pivotal", etc., as applied to the jaw members of the present invention are relative terms used to facilitate identification of the jaw members, since both jaw members are in the real sense movable relative to each other.

Figure 2:
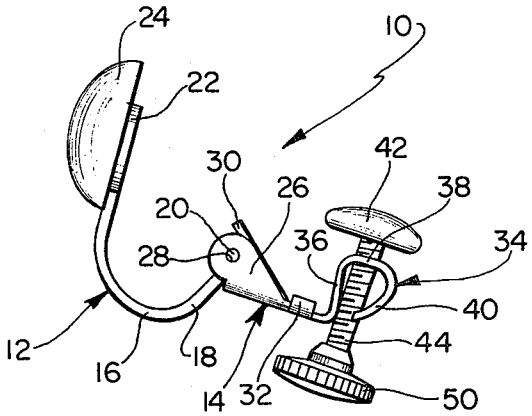
FIG. 2 is a side elevational view similar to FIG. 1 depicting the movable jaw moved to its open position.
Figure 3:
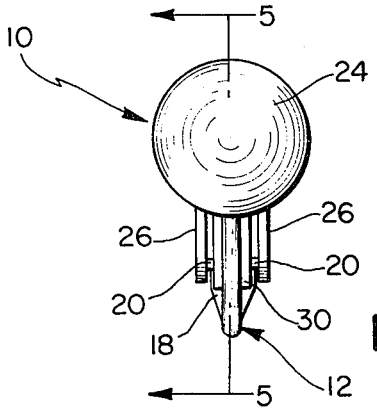
FIG. 3 is an end view of the device as viewed from the left side of FIG. 1.
Figure 5:
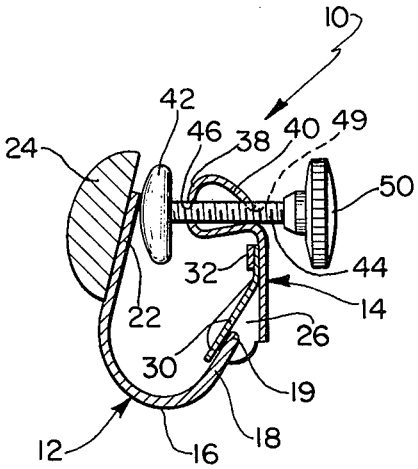
FIG. 5 is a sectional view taken along line 5—5 of FIG. 3.
Figure 6:
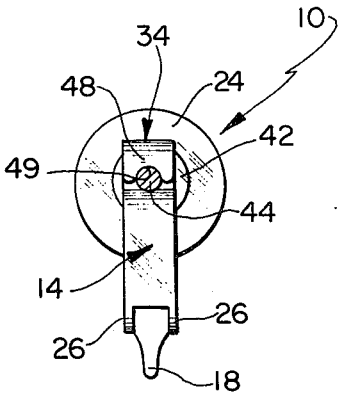
FIG. 6 is an end view of the device taken from the right side of FIG. 1.

Referring to the drawing, an earring 10 is shown as comprising a stationary jaw member 12 and a movable jaw member 14 connected together at lower portions thereof as will hereinafter be more clearly brought out. Jaw 12 is of overall J-shaped configuration having a lower curved loop portion 16 which extends upwardly in a short arm 18 which in turn terminates in an outer edge 19 having outwardly extending pintles 20. The other end of the jaw 12 terminates in a generally circular pad or contact member 22 and is provided at an outer portion thereof with a decorative element 24. Contact 22 is adapted to press inwardly on outer portions of the ear lobe of the person wearing the earring 10, and the lower loop portion 16 is adapted to extend snugly around the lower portions of the ear lobe. The movable jaw 14 exhibits a generally tubular construction having a pair of generally parallel spaced ears 26, each having an opening 28 therethrough for receipt of the pintles 20 provided at the end of the fixed jaw 12. A leaf spring 30 is clamped to the jaw member 14 by bent lugs 32. One end of the leaf spring engages end portions of the terminal arm 18 as best shown in FIG. 5 of the drawing and is operable to maintain the jaws 12 and 14 in closed position as depicted in FIG. 5 or in an open position as best shown in FIG. 2 wherein the spring 30 contacts the outer edge 19 of the arm 18 disposed between the pintles 20. The other end of the leaf spring 30 terminates within or immediately after its connection with the jaw 14 by the upturned lugs 32. The above hinge construction and manner of operation is known and forms no part of the instant invention except to the extent that it contributes to the overall operation of the present device and its novel features.

Figure 1:
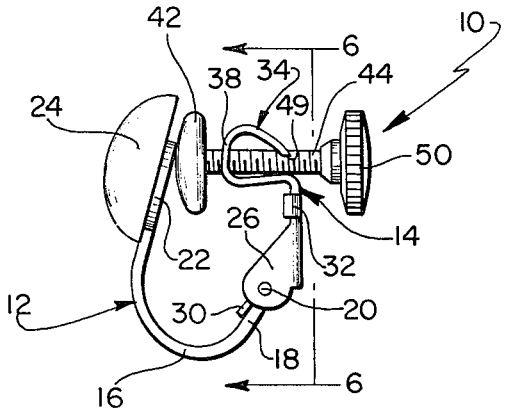
FIG. 1 is a side elevational view of an earring clip embodying the present invention.
Figure 4:
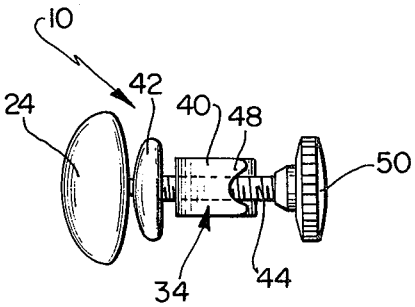
FIG. 4 is a top view of the device.

The other end of the jaw 14 terminates in a generally C-shaped loop 34 having base 36, root 38 and top 40 portions thereof. The loop 34 is abruptly bent, preferably immediately proximate to the bent lugs 32 so as to form the base portion 36 thereof. Such positioning of the base 36 as low as possible on the jaws 14 without any initial upwardly disposed loop run serves to minimize the overall length of the movable jaw 14, and accordingly a low overall profile is presented by the earring 10. The bend is preferably inward, as best shown in FIG. 1 of the drawing, so that the root portion 38 thereof is disposed proximate to the lobe contacting pad 42 of a screw member 44. The screw member 44 is adapted for positioning transversely of the movable jaw 14 and within a smooth bore or opening 46 formed within the root portion 38 of the C-shaped loop. The terminal end 48 of top portion 40 of the loop 34 projects downwardly into contact with the upper side of the screw member 44 so that such is engaged by the loop at two spaced locations thereof, as hereinafter more fully explained. The terminal end portion 48 may be arcuately recessed as best shown in FIG. 4 so as to enable its leading edge 49 to be disposed between the individual threads of the screw 44.

The other end of the screw member 44 is provided with a knurled head 50 so as to better enable the screw member 44 to be turned to effect axial movement back and forth with respect to the movable jaw 14 so that the spacing between contact 22 and contact 42 may be adjusted to accordingly vary the amount of pressure applied by the earring to the ear.

It should be apparent that the threaded member 44 is threadedly engaged at two spaced locations by the C-shaped loop 34, that is, its contact with the upper edge of opening 46 in the root portion 38 thereof and its contact with the relatively sharp edge 49 of the terminal portion 48. Additionally, the base portion 36, preferably at the point at which it is abruptly bent from the main body of the jaw 14, may engage lower portions of the screw member 44 so as to support same and maintain it in contact with the terminal edge 49. Such engagement of the screw member 44 at only two spaced points assures proper threaded mounting of the screw member while at the same time minimizing frictional resistance against turning movement thereof.

Accordingly, the operation of the present device over known constructions is smoother and affords a somewhat softer and easier adjusting touch by reason of the attendant friction reduction which results from the use of the smallest number of contact points along the loop 34 which will serve to properly mount and support the screw member for the desired threaded movement thereof. Furthermore, the configuration of the loop 34, as illustrated, minimizes the height of the movable jaw 14, thus resulting in a relatively short or low profile earring, which has been found to be desirable and beneficial for many reasons.

The jaws 12 and 14 and screw member 44 may be constructed of any suitable metallic material, such as brass, although member 14 is preferably spring tempered so that end portion 48 may make resilient engagement with the screw member 44. Likewise, spring 30 is also constructed of any suitable spring material, such as beryllium copper or the like.

While there is shown and described herein certain specific structure embodying the invention, it will be manifest to those skilled in the art that various modifications of the parts may be made without departing from the spirit and scope of the underlying inventive concept and that the same is not limited to the particular forms herein shown and described except insofar as indicated by the scope of the appended claims.

What is claimed is:

1. A clip for earrings and the like comprising, a fixed jaw member having means for contact with the lobe of a person's ear, a movable jaw member pivotally connected to said fixed jaw member at one end thereof, spring means extending between said movable jaw member and said fixed jaw member for urging said movable jaw member towards said fixed jaw member, said movable jaw member terminating in a generally C-shaped loop having base, root and top portions at the other end thereof, said loop having a smooth bore in the root portion thereof for receipt of a screw with an edge portion of said bore in engagement therewith, said screw positioned transversely of said movable jaw member and provided at one end thereof with contact means adapted to cooperate with said contact means on said fixed jaw member for engaging the opposite side of said ear lobe and at the other end thereof with means for manually rotating said screw for transverse movement relative to said movable jaw member for adjusting the spacing between said contact means and accordingly the amount of pressure applied to mount the earring on the ear, the top portion of said loop having a relatively sharp terminal edge projecting toward and in contact with the upper side of said screw between adjacent threads thereof so that said screw is engaged by said loop at two spaced locations thereof, and means on said movable jaw urging said screw upwardly against said terminal edge.

2. In the earring clip construction of claim 1, said root portion of said C-shaped loop disposed proximate to said screw member contact means.

3. In the earring clip construction of claim 2, said urging means comprising the base portion of said loop contacting the bottom portions of said screw member.

4. In the earring clip construction of claim 2, said movable jaw being abruptly inwardly bent towards said screw member contact means to form said base portion of said loop, said base portion extending longitudinally of said screw member and closely adjacent thereto.

5. In the earring clip of claim 4, said urging means comprising the base portion of said loop where abruptly bent in contacting relation with the bottom portions of said screw.

6. In the earring clip of claim 4, said spring means comprising a flat leaf spring connected to said movable jaw member and bearing at one end thereof against said fixed jaw member, said abrupt inward bend in said movable jaw disposed proximate the connection of said leaf spring thereto.

* * * * *